US005096184A

United States Patent [19]

Maekawa et al.

[11] Patent Number: 5,096,184

[45] Date of Patent: Mar. 17, 1992

[54] PAPER DISCHARGE APPARATUS FOR RECORDING SYSTEM

[75] Inventors: Yoshikazu Maekawa; Tetsuo Hirata, both of Hachioji, Japan

[73] Assignee: Konica Corporation, Tokyo, Japan

[21] Appl. No.: 704,857

[22] Filed: May 21, 1991

Related U.S. Application Data

[63] Continuation of Ser. No. 378,693, Jul. 11, 1989, abandoned.

[30] Foreign Application Priority Data

| | | | |
|---|---|---|---|
| Jul. 12, 1988 | [JP] | Japan | 63-173289 |
| Jul. 12, 1988 | [JP] | Japan | 63-173290 |
| Feb. 20, 1989 | [JP] | Japan | 1-40925 |

[51] Int. Cl.[5] ..... B65H 39/10

[52] U.S. Cl. ..... 271/288; 271/294; 271/298; 271/184; 271/207

[58] Field of Search ..... 271/184, 225, 288, 294, 271/298, 299, 207

[56] References Cited

U.S. PATENT DOCUMENTS

| | | | |
|---|---|---|---|
| 4,091,978 | 5/1978 | Graham | 271/184 |
| 4,603,850 | 8/1986 | Horiuchi | 271/298 |
| 4,688,786 | 8/1987 | Takahata | 271/294 |
| 4,709,915 | 12/1987 | Ishikawa et al. | 271/288 |
| 4,751,550 | 6/1988 | Murakami | 271/288 |

FOREIGN PATENT DOCUMENTS

| | | | |
|---|---|---|---|
| 0002155 | 1/1983 | Japan | 271/294 |
| 0008943 | 1/1987 | Japan | 271/288 |

*Primary Examiner*—H. Grant Skaggs

*Attorney, Agent, or Firm*—Finnegan, Henderson, Farabow, Garrett and Dunner

[57] ABSTRACT

A paper discharge apparatus for a recording system includes a plurality of vertically movable bins, arranged vertically stepwise, for receiving a recorded sheet discharged from a recording system main body, a lifting mechanism, a shifting unit, and a selection shift selecting unit, and a shift operation control unit. The lifting mechanism moves the bins upward/downward stepwise in synchronism with a sheet discharging operation in a sort mode. The shifting unit transversely shifts a discharging direction of a recorded sheet from a normal discharging direction. The selection shift selecting unit selects a shift mode or a non-shift mode as a discharge mode. The shift operation control unit operates the shifting unit such that when a number of sets of recorded sheets more than the number of bins are to be discharged in the sort mode, sets of recorded sheets discharged exceeding the number of bins are shifted and discharged in a reverse order from the lowermost bin or the uppermost bin, and recorded sheets for the next original are shifted and discharged from the last used bin of an immediately preceding original to the lowermost or uppermost bin and discharged without shifting to the first bin thereafter.

3 Claims, 11 Drawing Sheets

ODD-NUMBERED BIN

EVEN-NUMBERED BIN
1

SORT KEY
63
I F
67
GROUP KEY
64
I F
68
NON-SORT KEY
65
I F
69
SHIFT KEY
66
I F
70
CPU
61
I F
71
PAPER DISCHARGE ROLLER OFFSET MEANS
40
I F
72
BIN-ASCENT/DESCENT CONTROL MEANS
35
ROM
62
60

150

PAPER DISCHARGE APPARATUS FOR RECORDING SYSTEM

This application is a continuation of application Ser. No. 07/378,693 filed July 11, 1989, now abandoned.

BACKGROUND OF THE INVENTION

1. Field of the Invention

The present invention relates to a paper discharge apparatus for a recording system for use in combination with a recording system such as an electrophotographic copying machine.

2. Description of the Prior Art

In recent years, an electrophotographic copying machine has been widely used. In many copying machines, a paper discharge apparatus for externally receiving a copied sheet is arranged as a part of a copying machine main body. In a large or high-speed copying machine, however, an independent paper discharge apparatus 30 is connected to a copying machine main body 20, as shown in FIG. 1. The paper discharge apparatus 30 of this type has a main tray 33 at a top position and a plurality of bins 32 below the main tray 33. The paper discharge apparatus 30 also includes a bin driver 31 for driving the main tray 33 and the bins 32.

The bin driver 31 has a bin ascent/descent control means 35 for moving the main tray 33 and the bins 32 upward/downward. Reference numeral 36 denotes a motor for applying a driving force to the control means 35.

A guide plate 39 for a copying sheet 1 (indicated by an alternate long and short dashed line in FIG. 1) and paper discharge rollers 41 located between the guide plate 39 and the main tray 33 are arranged at substantially the central portion of the driver 31. By driving the paper discharge rollers 41, the copying sheet 1 is discharged into the main tray 33 or a bin 32.

In the paper discharge apparatus 30 of this type, by moving the main tray 33 and the bins 32 upward or downward, a copying sheet is discharged in a corresponding bin. Since an ascent/descent state of the bins is controlled in accordance with the number of sets of copies, copied sheets 1 are discharged in the respective bins as shown in, e.g., FIG. 2A. In FIG. 2A, the number of bins is four. In this case, leading edges la of the copying sheets 1 received in the bins are always aligned as shown in FIG. 2A.

For this reason, when the copying sheets 1 are removed from a plurality of bins, all of the copying sheets removed from all the bins overlap each other as shown in FIG. 2B.

Therefore, when copying sheets are simultaneously removed, for example, they must be sorted in units of bins, resulting in very cumbersome work.

In order to solve this problem, as shown in FIG. 2C, leading or side edges of copying sheets discharged into bins may be offset alternately in odd- and even-numbered bins. For this purpose, a paper discharge apparatus for shifting discharged copying sheets right and left (i.e., in the widthwise direction of a sheet) is proposed in Japanese Patent Publication No. 63-27253. In this paper discharge apparatus, a paper discharge tray is oscillated in order to shift copying sheets right and left.

When copying of a number of sets of copies exceeding the number of bins is performed by using such a shift type paper discharge apparatus, copying sheets are alternately shifted and stacked one after another, thereby increasing a resistance caused by static electricity or friction between the copying sheets. Therefore, especially in the case of copying of a large number of copying sheets, the sorted copying sheets are easily misaligned when they are removed from the bins. In this case, since sorting is disturbed, the copying sheets require realignment.

The paper discharge apparatus 30 as shown in FIG. 1 has two types of paper discharge modes, i.e., sort and non-sort modes. In the non-sort mode, the copying sheets 1 are discharged in only the main tray 33. In the sort mode, the main tray is used as a bin, and a set number of copying sheets 1 are sorted and discharged in the main tray 33 and the remaining bins 32. Therefore, when the last bin is used, the bin ascent/descent control means 35 drives and moves the bins 32 upward as shown in FIG. 3.

In the paper discharge apparatus 30 having the above arrangement, the copying sheets 1 are received in only the main tray 33 when the non-sort mode is selected. The number of copies which can be received in the main tray 33 is normally about 150 to 200. Therefore, in order to copy a number of sheets larger than this number in the non-sort mode, the maximum receivable number of sheets of the main tray 33 is set. After the receivable number of copies are received , the copying sheets are removed of the main tray 33, and the number of remaining copies is set to perform copying. This operation and work are very cumbersome.

When a user sets the number of copies larger than the receivable number of the main tray 33, copying sheets sometimes overflow from the main tray 33 to the outside, thereby causing jamming.

SUMMARY OF THE INVENTION

The present invention has been made in consideration of the above situation and has as its first object to provide a paper discharge apparatus in which when a number of sets of sheets larger than the number of bins are to be copied in a sort mode, copying sheets are discharged such that sets of sheets discharged exceeding the number of bins can be sorted with minimum friction by switching a shift operation upon discharging.

It is a second object of the present invention to provide a paper discharge apparatus in which when a number of sheets more than the number of receivable sheets of a main tray are to be copied, overflowing copying sheets are automatically discharged in bins arranged below the main tray.

In order to achieve the first object of the present invention, there is provided a paper discharge apparatus, comprising a plurality of bins, for discharging a copying sheet in a corresponding bin by ascent/descent of a plurality of bins, which has a function of selecting a shift mode in which a copying sheet is shifted and discharged in a direction different from a normal paper discharging direction of a copying sheet in each bin and has a processing routine in which when a number of sets of copying sheets more than the number of bins are to be copied and sorted, sets of copying sheets discharged exceeding the number of bins are shifted and discharged in a reverse order from the last bin which is the lowermost or uppermost bin, and copying sheets for the next original are discharged from the last used bin for an immediately preceding original to the lowermost or uppermost bin, shifted at the lowermost or uppermost bin, and then discharged up to the first bin.

In order to achieve the second object of the present invention, there is provided a paper discharge apparatus, comprising a main tray and a plurality of bins, for discharging a copying sheet in a corresponding bin by ascent/descent of a plurality of bins, wherein when a number of copying sheets more than the number of receivable sheets of the main tray are to be copied in a non-sort mode using only the main tray, overflow processing is performed to discharge remaining copying sheets in bins.

BRIEF DESCRIPTION OF THE ACCOMPANYING DRAWINGS

FIGS. 7A and 7B are views for explaining discharged states of copied sheets by the paper discharge apparatus according to the present invention, in which FIG. 7A shows a non-shift state and FIG. 7B shows a shift state;

FIG. 8 is a block diagram showing a schematic arrangement of the controller of the paper discharge apparatus according to the present invention;

DETAILED DESCRIPTION OF PREFERRED EMBODIMENTS

An embodiment in which a paper discharge apparatus having shifting and sorting functions according to the present invention is applied to a normal paper copying machine as described above will be described in detail below with reference to the drawings from FIG. 4.

Figure 1:
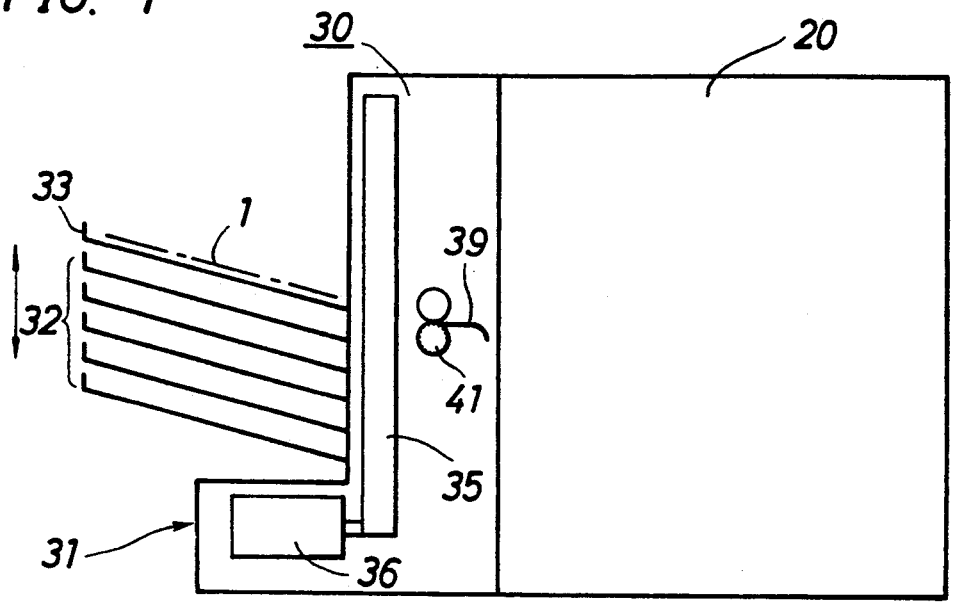
FIG. 1 is a schematic view showing a paper discharge apparatus according to the present invention in a state in which it is connected to a copying machine main body.

The paper discharge apparatus according to the present invention is connected to a copying machine main body 20 as shown in FIG. 1 and has a basic structure similar to that shown in FIG. 1.

Figure 3:
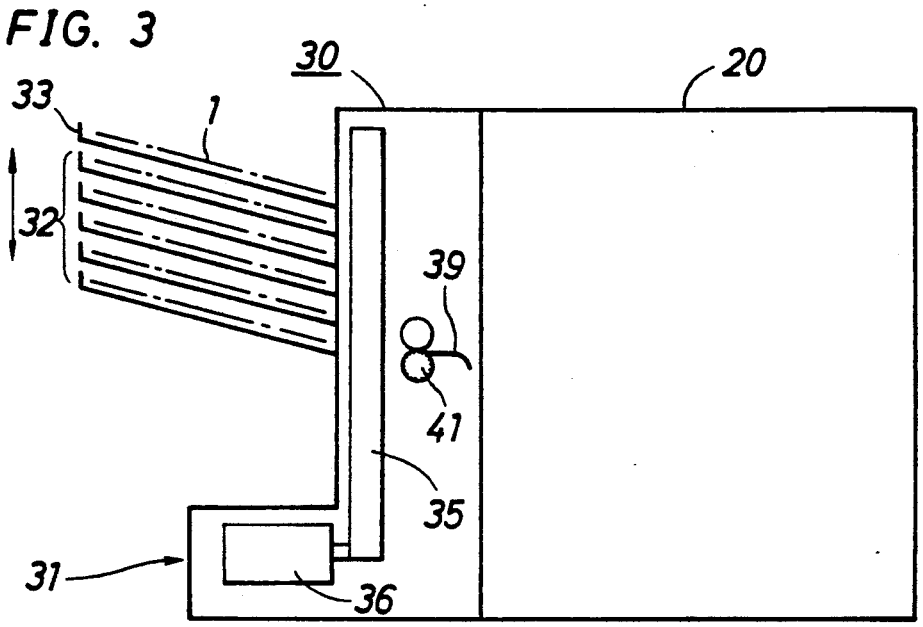
FIG. 3 is a schematic view similar to FIG. 1 showing a paper discharge apparatus according to the present invention in a state in which it is connected to a copying machine main body.

In the paper discharge apparatus 30, a bin ascent/descent control means 35 is driven to move a main tray 33 and bins 32 upward or downward by one bin. Therefore, when the bins 32 are moved upward to the uppermost level as shown in FIG. 3, a copying sheet 1 can be discharged in the last bin 32 by paper discharge rollers 41.

In the present invention, two paper discharging directions of the copying sheet 1 to be discharged in a plurality of bins 32 can be controlled. That is, as a paper discharge mode of the paper discharge apparatus 30, one of two modes, i.e., non-shift and shift modes can be selected.

In the non-shift mode, a copying sheet is discharged in a normal paper discharging direction. As a result, copying sheets are discharged as in odd-numbered bins shown in FIG. 4A. Note that in FIGS. 4A and 4B, bins are viewed from a copying sheet discharging direction.

Figure 2A:
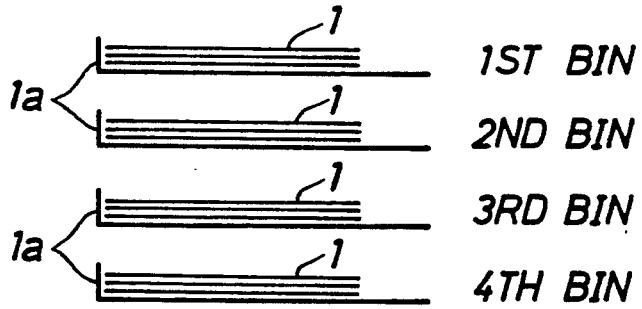
FIGS. 2A to 2C are views showing discharged states of copied sheets by a conventional paper discharge apparatus.
Figure 2B:
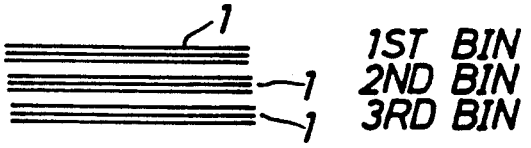
Figure 2C:
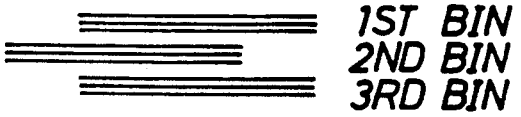

In the shift mode, a copying sheet is discharged in a right or left direction (i.e., the widthwise direction of a sheet) different from the normal paper discharging direction. Therefore, copying sheets are discharged as in even-numbered bins shown in FIG. 4A. When copying sheets discharged in a plurality of bins are removed in the shift mode, copying sheets in the respective bins are alternately offset right and left as shown in FIG. 2C, thereby facilitating following processing.

Figure 5:
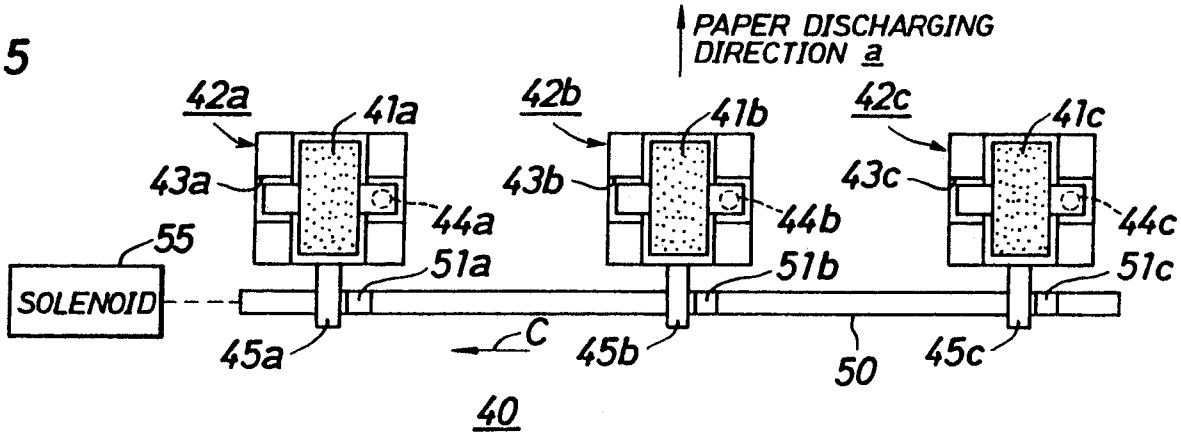
FIG. 5 is a schematic view showing an arrangement of a paper discharge roller shaft offset means used in the paper discharge apparatus according to the present invention.

In order to allow selection of one of the two paper discharging modes as described above, a paper discharge roller shaft offset means 40 as shown in FIG. 5 is provided for paper discharge rollers. In this embodiment, a paper discharge means is constituted by three paper discharge rollers (41*a* to 41*c*).

The paper discharge rollers 41*a*, 41*b*, and 41*c* are housed in roller mounting means 42*a*, 42*b*, and 42*c*, respectively. The paper discharge rollers 41*a*, 41*b*, and 41*c* have the same structure, and the roller mounting means 42*a*, 42*b*, and 42*c* have the same structure. Therefore, only the paper discharge roller 41*a* and the roller mounting means 42*a* will be described below. As shown in FIG. 5, the roller mounting means 42*a* has a recess at its central portion, and bearing portions 43*a* are formed at right and left end portions of the recess. A shaft of the paper discharge roller 41*a* is fitted in the bearing portions.

A shaft 44*a* is integrally formed on the center of the lower surface at the right side of the roller mounting means 42*a*. The shaft 44*a* is rotatably fixed to a base plate (not shown) for mounting the paper discharge roller.

A lever 45*a* extends from one side surface of the roller mounting means 42*a*. An operation lever 50 is arranged at the lower side of the levers 45*a* to 45*c*, and projections 51*a* to 51*c* are integrally formed on the operation lever 50. In a state as shown in FIG. 5, the lever 45*a* and the projection 51*a*, for example, abut against each other.

The operation lever 50 is driven in a direction indicated by an arrow by a movement control means such as a solenoid 55.

In the paper discharge roller shaft offset means 40 having the above arrangement, when the paper discharge rollers 41*a*, 41*b*, and 41*c* are driven in the state as shown in FIG. 5, a paper discharging direction of the copying sheet 1 discharged upon driving corresponds to an arrow a.

Figure 6:
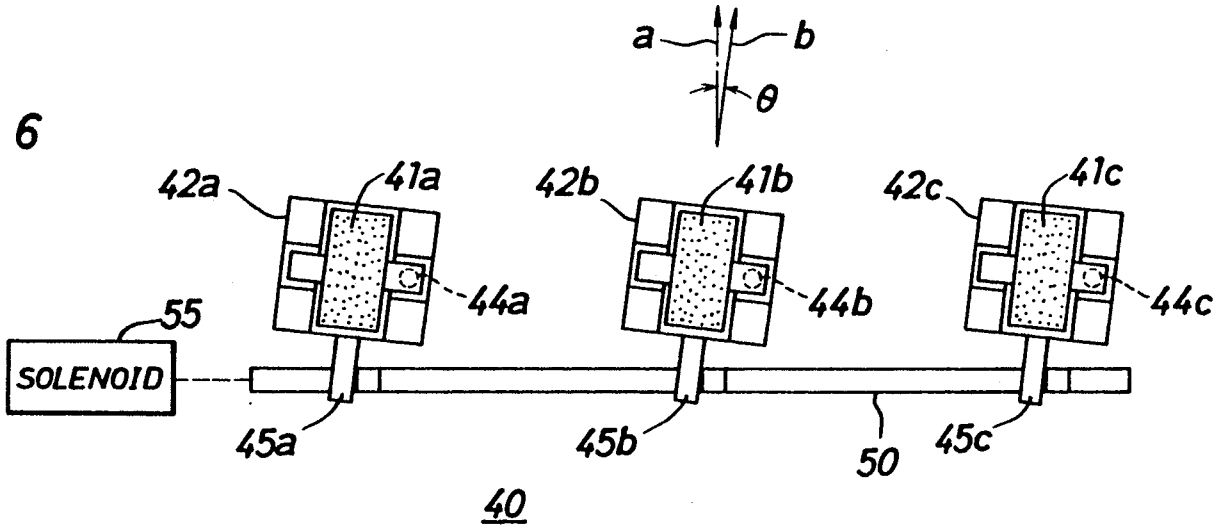
FIG. 6 is a schematic view for explaining a shift operation performed by the paper discharge roller shaft offset means shown in FIG. 5.

When the solenoid 55 is energized to move the operation lever 50 in the arrow direction c, the paper discharge roller 41*a* to 41*c* are inclined through a predetermined angle $\theta$ as shown in FIG. 6. As a result, a paper discharging direction b of the copying sheet 1 discharged by the rollers 41*a* to 41*c* is inclined through the angle $\theta$. In this manner, the copying sheet to be discharged in the bin 32 is shifted right from the direction shown in FIG. 5.

In this embodiment, a paper discharge mode in which a copying sheet is discharged in the paper discharging direction a shown in FIG. 5 is called the non-shift mode, and a paper discharge mode in which a copying sheet is discharged in the paper discharging direction b as shown in FIG. 6 so as to be shifted right is called the shift mode.

By changing the direction of the paper discharge rollers 41*a* to 41*c* as described above, the copying sheets 1 to be received in the bins 32 can be shifted right and left. A shift amount is determined by a displacement angle $\theta$ shown in FIG. 6 and a paper feed amount.

Figures 7A, 7B, 8:
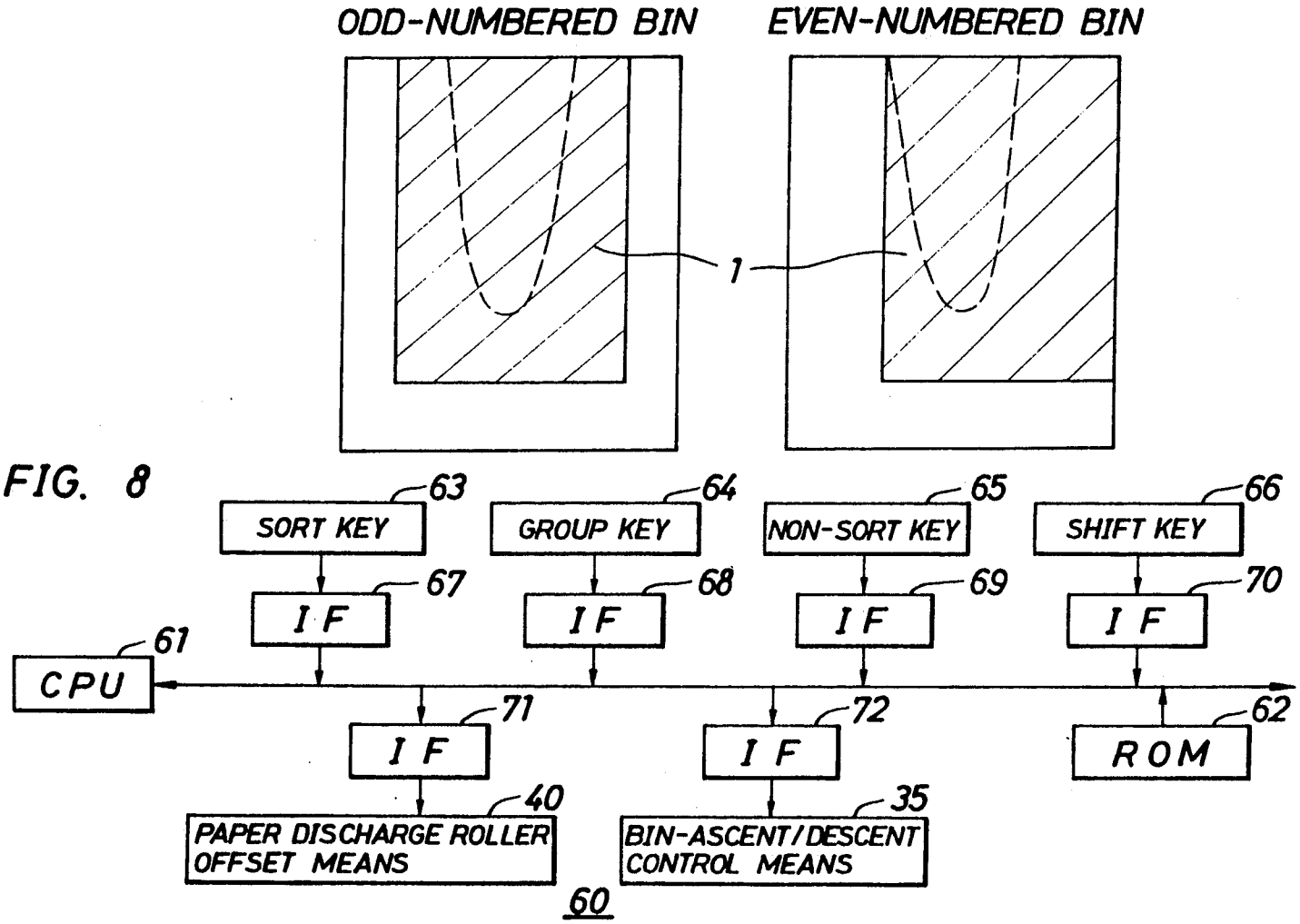

Various paper discharge modes can be realized by using the above offset means 40. For example, by switching the offset means 40, copying sheets are discharged in odd-numbered bins (a first bin, a third bin, . . . ) in the non-shift mode and in even-numbered bins (a second bin, a fourth bin, . . . ) in the shift mode. As a result, the discharged copying sheets (hatched portions in FIGS. 7A and 7B) are offset right and left in the bins as shown in FIGS. 7A and 7B). Even when the copying sheets 1 offset right and left int he odd- and even-numbered bins are simultaneously removed therefrom, following sorting can be easily performed.

A series of control means for selecting the paper discharge mode of the paper discharge apparatus 30 are arranged as shown in FIG. 8.

In a paper discharge control means 60 shown in FIG. 8, reference number 61 denotes a CPU for controlling the entire apparatus; and 62, a ROM which stores control programs.

The CPU 61 controls the apparatus in accordance with a key input from an operation panel of the copying machine main body 20. FIG. 8 shows typical keys of the operation panel, in which reference numeral 63 denotes a sort key; 64, a group key; 65, a non-sort key; and 66, a shift key.

The sort key 63 is for realizing a sort mode. In the sort mode, a plurality of bins are used to perform copying, and copying sheets for each page are sorted and discharged in the respective bins 32 so that the copying sheets of one set are received in the respective bins.

The group key 64 is for realizing group mode copying. In the group mode, a plurality of copies of the same page are made and discharged on the same bin.

Key inputs from a plurality of keys 63 to 66 are supplied to the CPU 61 via interfaces 67 to 70, respectively, and control corresponding to the operated key is executed.

On the basis of a command supplied from the CPU 61 in accordance with the key input, the paper discharge roller shaft offset means 40 is driven via an interface (IF) 71, thereby realizing a corresponding paper discharge mode. Similarly, a command signal from the CPU 61 is supplied to the bin ascent/descent control means 35 via an interface (IF) 72. The bin ascent/descent control means 35 is driven as desired to discharge the copying sheet 1 in the corresponding bin 32.

An operation of the paper discharge apparatus 30 will be described in detail below with reference to the drawings from FIG. 9.

For the sake of descriptive convenience, first to fourth shift processing operations will be exemplified in the following description.

An example of the first shift processing is interrupt processing.

This is, when interruption occurs wile a plurality of sheets are copied, a paper discharge mode immediately before the interruption is checked, and a paper discharge mode difference from the checked paper discharge mode is automatically set.

In this manner, copying sheets copied immediately before the interruption can be easily distinguished from those copied after the interruption.

Figure 9:
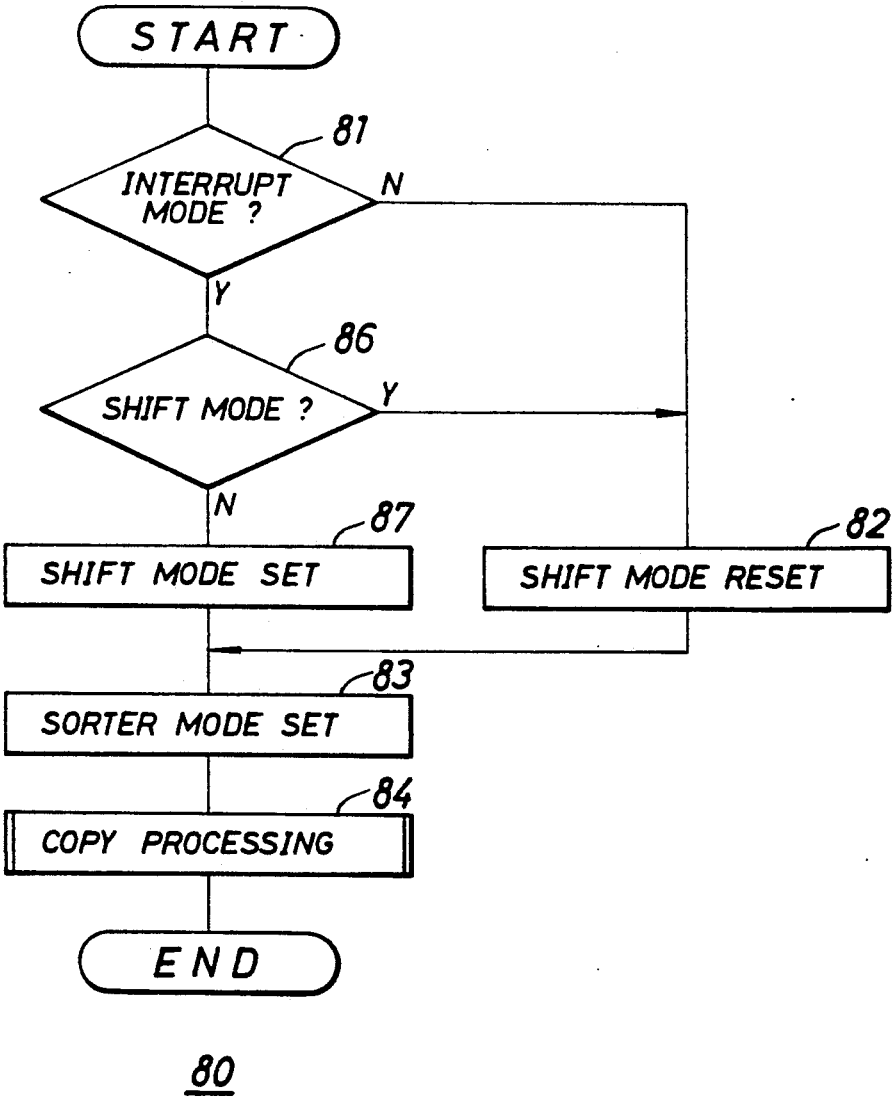
FIG. 9 is a flow chart for explaining first shift processing in an operation of the paper discharge apparatus according to the present invention.

FIG. 9 is a flow chart showing an example of a first shift processing routine 80 for interruption. When an interrupt mode is set (step 81), whether a paper discharge mode immediately before interruption is the shift mode is checked (step 86). If the paper discharge mode immediately before the interruption is the shift mode, the shift mode is released (step 82), and a sort mode is set to execute copy processing (steps 83 and 84).

If the immediately preceding paper discharge mode is not the shift mode, the shift mode is set (step 87), and then the sort mode is set to start the copy processing (steps 83 and 84).

Figure 10A:
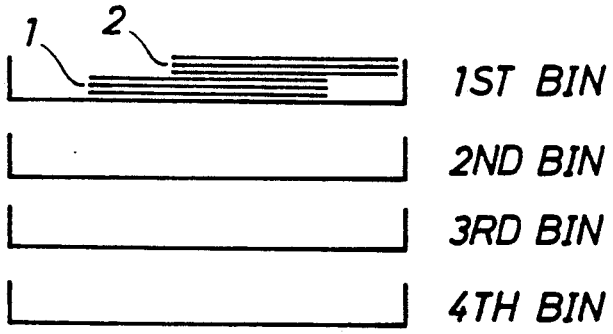
FIGS. 10A, 10B, 11A and 11B are views showing different paper discharge states in the first shift processing shown in FIG. 9.

In this manner, copy states as shown in, e.g., FIGS. 10A to 11B can be realized. FIGS. 10A and 10B show a case in which the paper discharge mode immediately before the interruption is the non-shift mode. Referring to FIG. 10A, the interruption mode is set while the copying sheets 1 are discharged in a first bin (or the main tray 33).

In this case, since the shift mode is automatically set as the paper discharge mode, copying sheets 2 discharged in the interrupt/shift mode are shifted and discharged on the same first bin so that their side edges are offset, as shown in FIG. 10A.

Figure 10B:
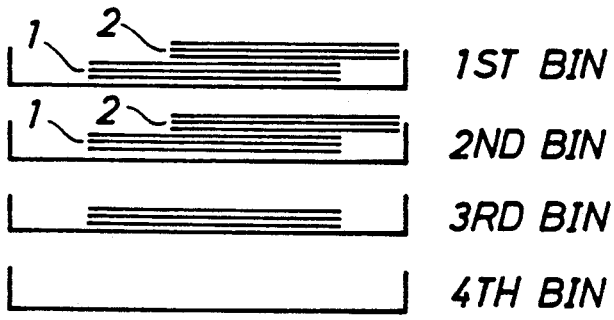

Referring to FIG. 10B, the interrupt mode is set to make two sets of copies while the copying sheets 1 are discharged in the first to third bins in the non-shift mode.

In this case, copying sheets 2 discharged in the first and second bins after the interruption are shifted and discharged on the immediately preceding copying sheets 1 so that their side edges are shifted by a predetermined length.

Figure 11A:
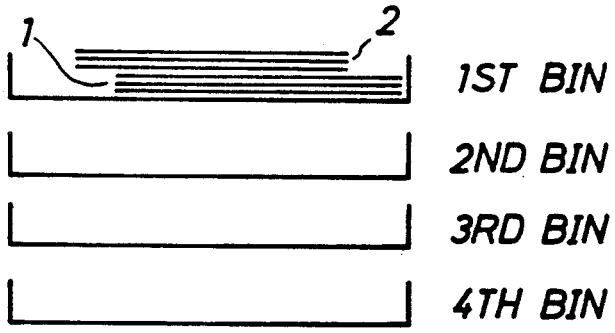
Figure 11B:
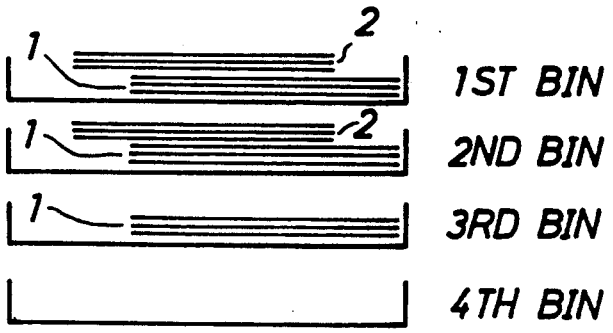

FIGS. 11A and 11B show a case in which the shift mode is selected as the paper discharge mode immediately before interruption.

In this case, when interruption occurs, the shift mode is reset and switched to the non-shift mode. Therefore, a relationship between the copying sheets 1 immediately before the interrupt mode and the copying sheets 2 after the interruption is obtained as shown in FIG. 11A or 11B.

In an example of the second shift processing, the non-shift and shift modes are alternately selected for the bins, and side edge positions of discharged copying sheets are shifted every other bin.

Figure 12:
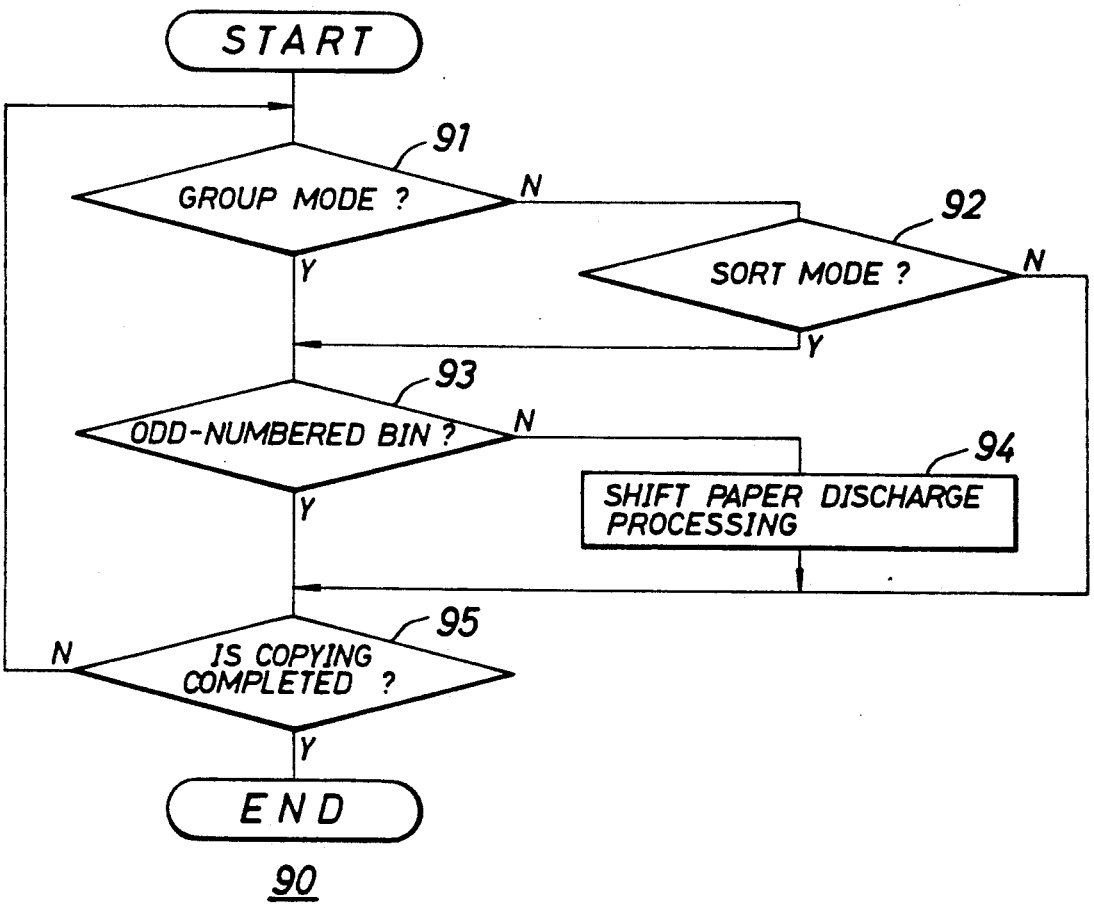
FIG. 12 is a flow chart for explaining second shift processing in the operation of the paper discharge apparatus according to the present invention.

FIG. 12 shows an example of a second shift processing routine 90. Referring to FIG. 12, whether the group mode or sort mode is set is checked (steps 91 and 92), and whether a bin currently receiving copying sheets is an odd-numbered bin is checked (step 93).

If the bin is an odd-numbered bin, the non-shift mode, i.e., the normal paper discharge mode is selected, and whether copying is completed is checked (step 95). If copying is not completed and an even-numbered bin is reached, shift paper discharge processing is executed (step 94), and a copying sheet is shifted and discharged.

Figure 4A:
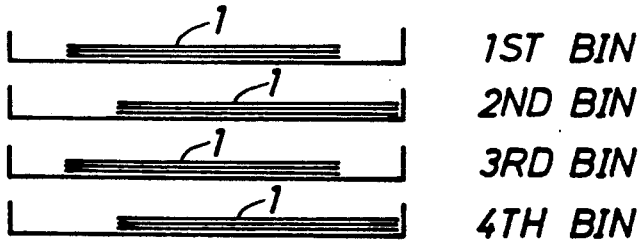
FIGS. 4A and 4B are views showing discharged states of copied sheets by the paper discharge apparatus according to the present invention.
Figure 4B:
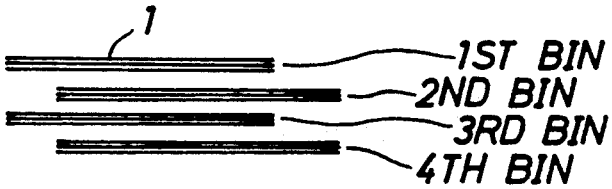

In this manner, as shown in FIG. 4A, the copying sheets 1 are discharged in the odd-numbered bins in the non-shift mode wile they are discharged in the even-numbered bins in this shift mode.

Contrary to the above example, the shift and non-shift modes can be executed for the odd- and even-numbered bins, respectively. However, since a copying sheet is normally discharged in an odd-numbered bin, the paper discharge state as shown in FIG. 4A is normally obtained.

In an example of the third shift processing, the shift mode is applied to utilize the bins efficiently as if they number twice the actual number of bins.

Figure 13:
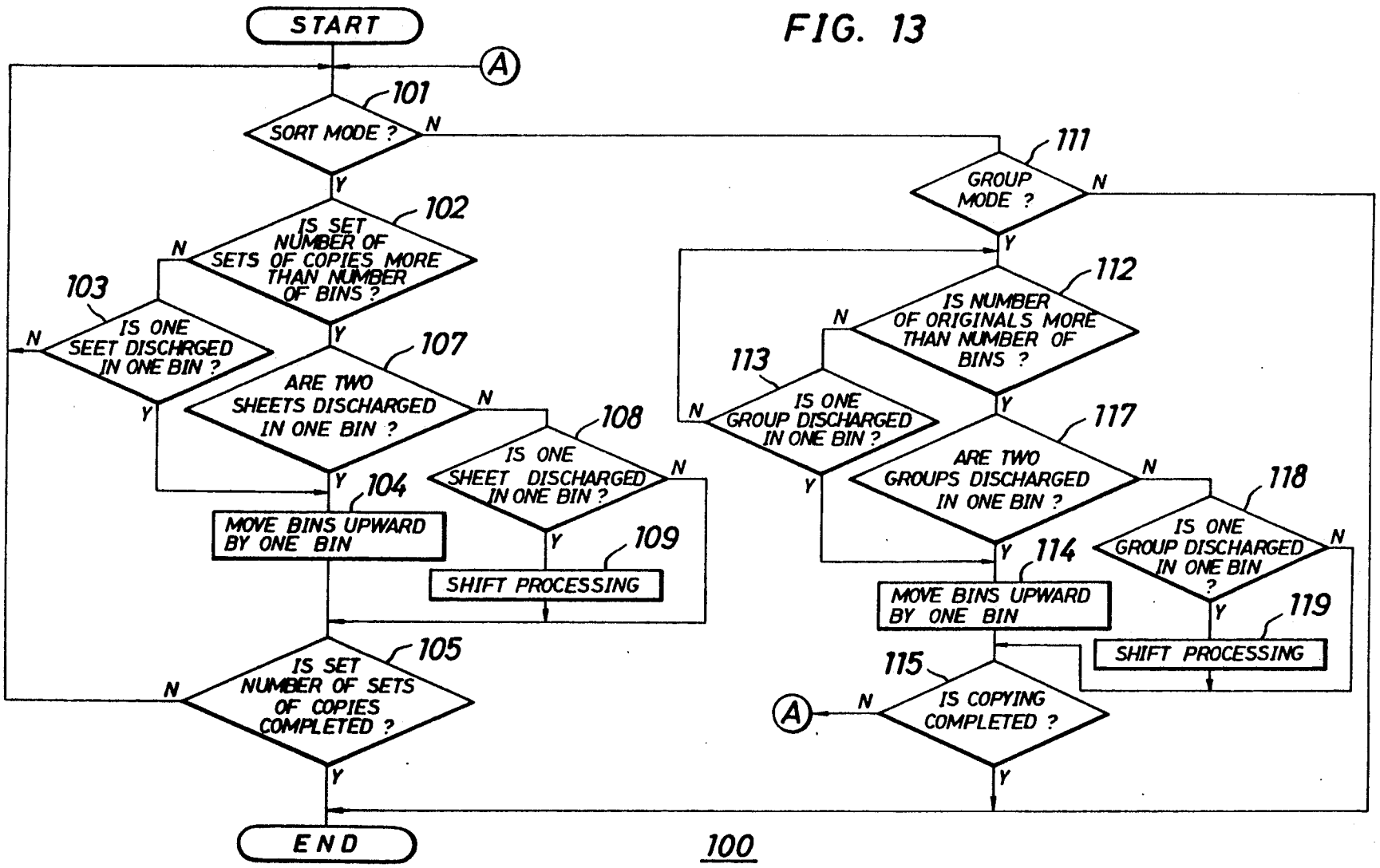
FIG. 13 is a flow chart for explaining third shift processing in the operation of the paper discharge apparatus according to the present invention.

FIG. 13 is a flow chart showing an example of a third shift processing routine 100. First, whether the sort or group mode is set is checked (steps 101 and 111).

If the sort mode is set, whether a set number of sets of copies is more than the number of bins is checked (step 102). If the set number of sets of copies is less than the number of bins, whether one copying sheet is discharged in one bin 32 is checked (step 103). If one copying sheet is received in one bin, the bins 32 are moved upward by one bin, and similar processing is repeated (steps 104, 105, and 101).

If the set number of sets of copies exceeds the number of bins, this is determined in step 102. In this case, whether two copying sheets are discharged in one bin is checked (step 107). If N (NO) in step 107, whether one copying sheet is discharged in the bin is checked again (step 108). If Y (YES) in step 108, the paper discharge mode is changed to the shift mode (step 109).

By this processing, a number of sets of copying sheets twice the number of bins can be discharged in the bins.

If the group mode is determined, whether the number of originals is more than the number of bins is similarly checked (step 112). If the number of originals is less than the number of bins, whether one group of copying sheets is discharged in one bin 32 is checked step 113).

When one group is copies, the bins 32 are moved upward by one bin (step 114), and this processing is executed until copying is completed (step 115). When the number of originals more than the number of bins is reached (step 112), whether two groups of copying sheets are discharged in one bin 32 is checked (step 117).

If one group is discharged in one bin, a copying sheet is shifted and discharged in the bin 32 (steps 118 and 119).

Therefore, in the group mode, two groups of copying sheets are received in one bin such that their side edges are shifted from each other.

Figure 14A:
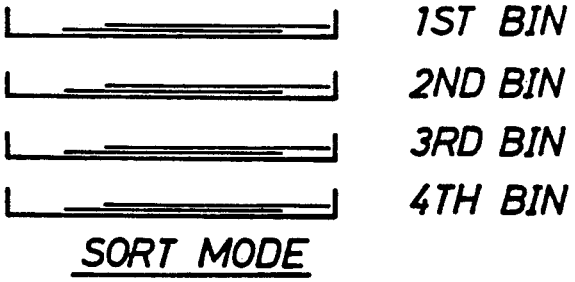
FIGS. 14A and 14B are views showing a paper discharge state in the third shift processing.
Figure 14B:
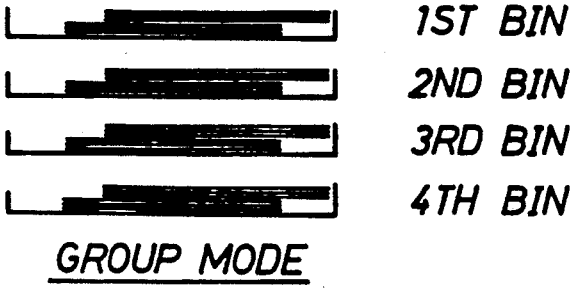

Therefore, copying sheets are discharged as shown in FIG. 14A in the sort mode, and they are discharged as shown in FIG. 14B in the group mode.

In the fourth shift processing, a receiving capacity of the bins is expanded to twice that of an actual number of bins as in the third shift processing. In the fourth shift processing, however, a receiving order of excessive copies is different from that of the third shift processing.

In the fourth shift processing, when a number of sets of copies more than the number of bins is set, the paper discharge mode is changed upon turing from the last bin so that the excessive copies can be received in the respective bins.

Figure 15:
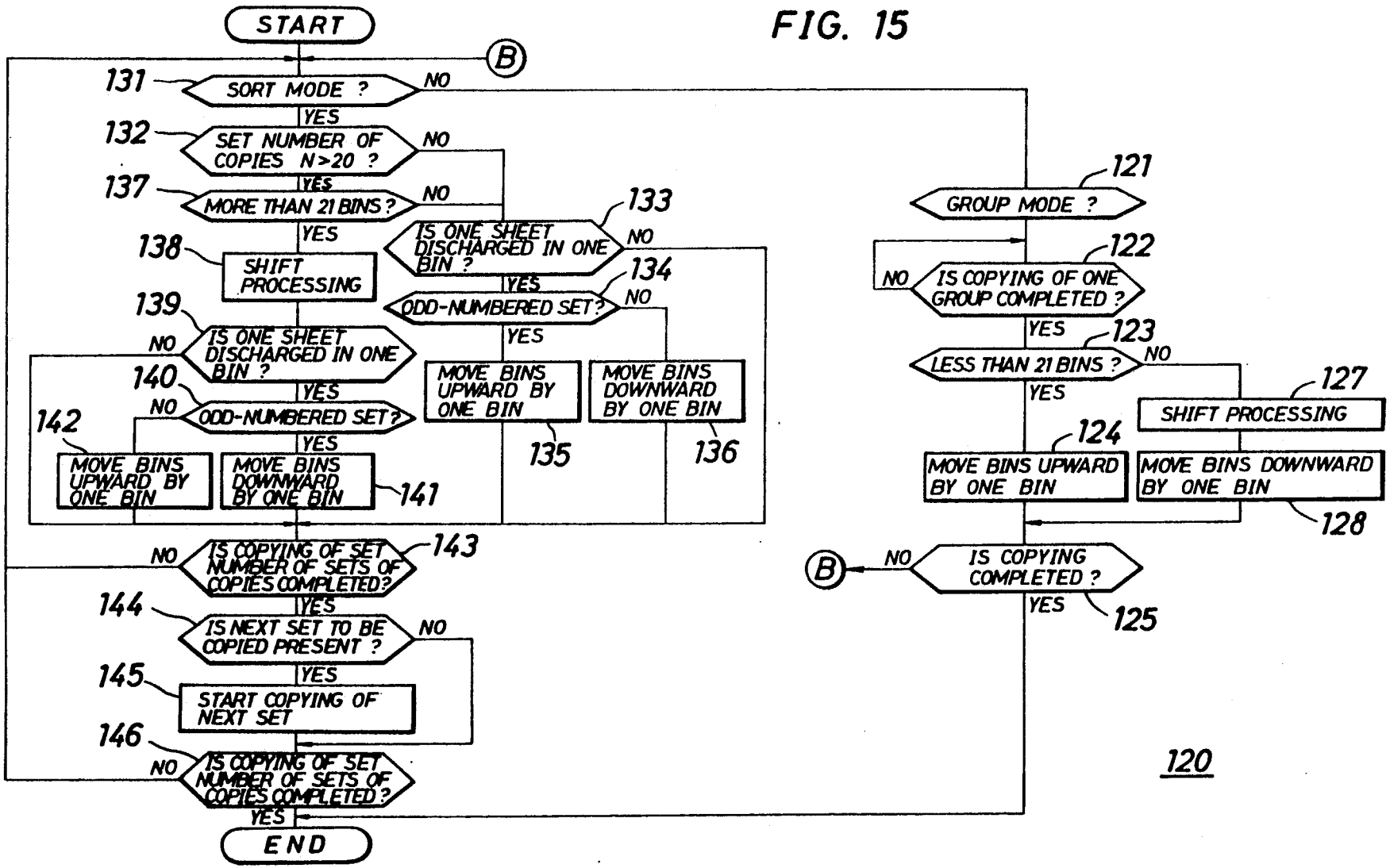
FIG. 15 is a flow chart for explaining fourth shift processing in the operation of the paper discharge apparatus according to the present invention.

For this purpose, a fourth shift processing routine 120 is as shown in FIG. 15.

Whether the sort mode is set (step 131) or the group mode is set (step 121) is checked, and whether a set number of sets of copies is more than the number of bins (in this case, the number of bins is 20) is checked (step 132).

If the sort mode is set and the set number of sets of copies is less than the number of bins, whether a copying sheet is discharged in a bin is of an odd-numbered set is checked (steps 133 and 134). If the copying sheet is of an odd-numbered set, the bins are moved upward by one bin. If the copying sheet is of an even-numbered set, the bins are moved downward by one bin (steps 135 and 136).

If the sort mode is set and the set number of sets of copies is more than the number of bins, the number of a set of a discharged copying sheet is checked (step 137). If the discharged copying sheet is of the 21st set, the bins are subjected to the shift processing (step 138).

Thereafter, whether a copying sheet discharge in a bin is of an odd-numbered set is checked (steps 139 and 140). If the discharged copying sheet is of an odd-numbered set, the bins are moved downward by one bin (step 141). If the discharged copying sheet is of an even-numbered set, the bins are moved upward by one bin (step 142).

If the number of the set of the copying sheet is determined to be not more than 20 in step 137, a processing routine performed when the set number of sets of copies is not more than 20 is performed to discharge copying sheets.

In this manner, copying sheets are continuously discharged until copying of a predetermined set number of copies is completed (step 143). After copying of one set of copies is completed, copying of the next set of copies is started (steps 144 and 145). When copying of a predetermined set number of sets of copies is completed, the paper discharge processing is ended (step 146).

After the group mode is determined in step 131 and copying of one group is completed (steps 121 and 122), if the set number of groups is less than the number of bins, the bins are moved upward by one bin (steps 123 and 124). If the set number of groups is more than the number of bins, the number of discharged groups is checked. If the number of the discharged groups is 21, the bin is subjected to the shift processing and the bins are moved downward by one bin (steps 127 and 128).

Figure 16:
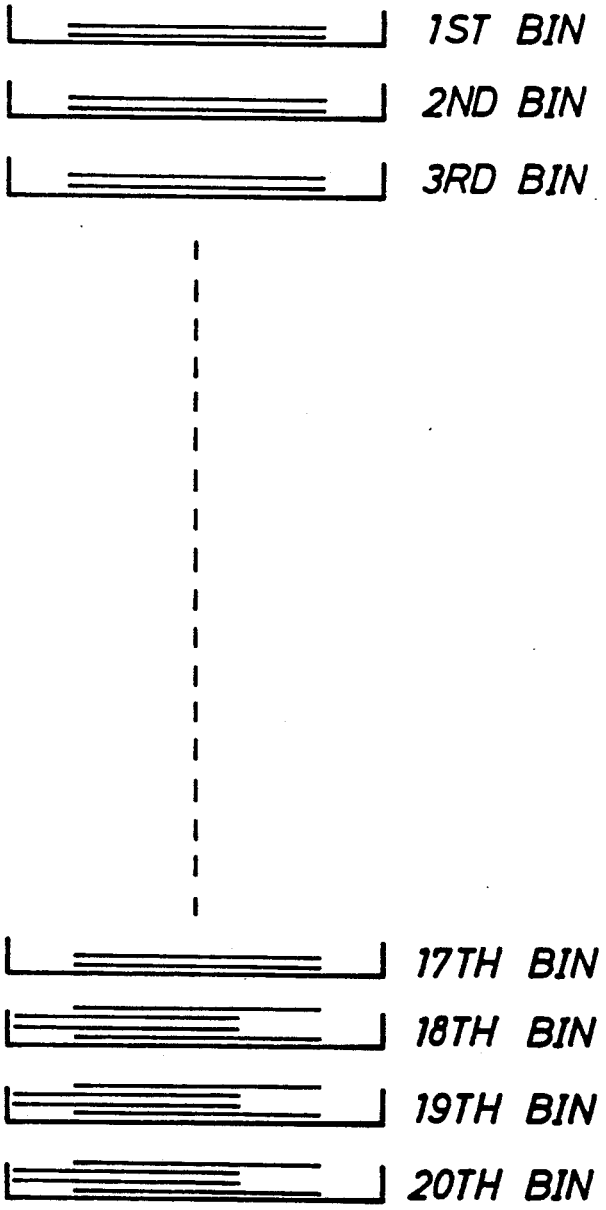
FIG. 16 is a view showing a paper discharge state in the fourth shift processing.

According to the above processing routine, a number of sets of copies discharged exceeding the number of bins are processed in the sort mode such that copying sheets are overlapped and discharged at shifted positions in unit of two sheets as indicated in 18th, 19th and 20th bins shown in FIG. 16. As a result, when each set of copies is removed from a bin, a frictional resistance between the paper surfaces is reduced by half. Therefore, each set of copies can be easily separated from another while copying sheets are kept aligned.

The paper discharge apparatus of this embodiment can execute overflow processing for the main tray by using a paper discharge control means 60 shown in FIG. 8.

Figure 17:
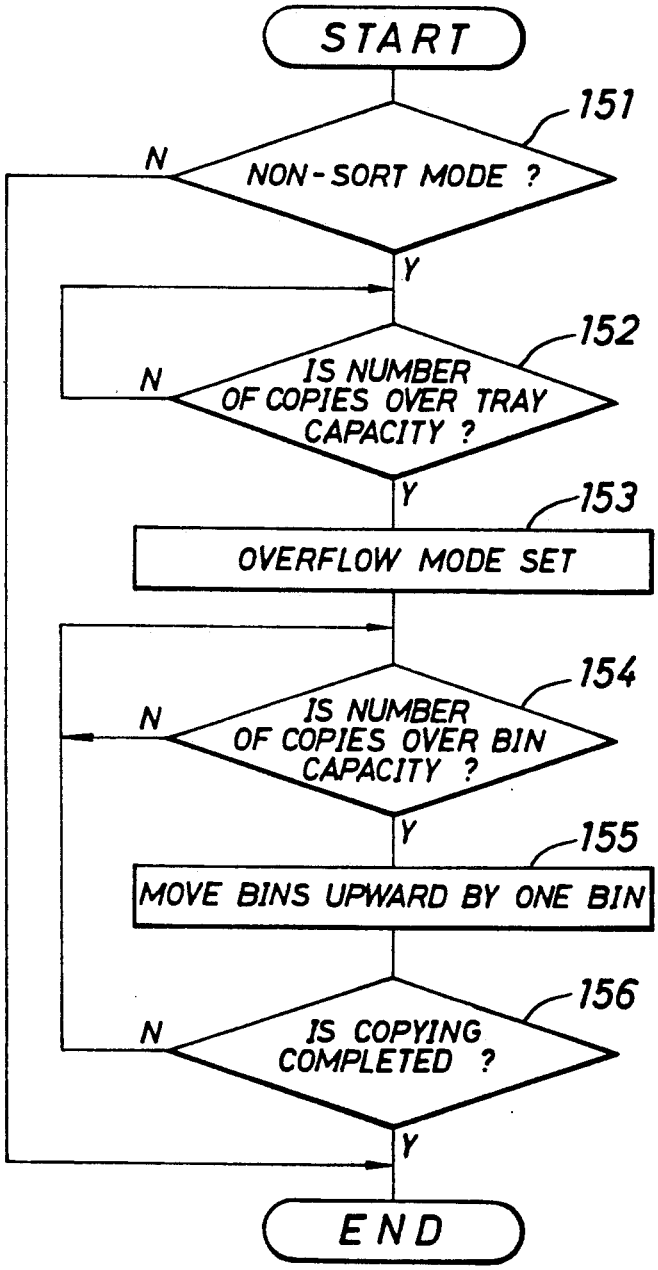
FIG. 17 is a flow chart for explaining fifth processing in the operation of the paper discharge apparatus according to the present invention.

FIG. 17 is a flow chart for explaining an overflow processing routine 150 as the fifth processing.

First, whether the paper discharge mode is the sort or non-sort mode is checked (step 151). If the paper discharge mode is the non-sort mode, whether the number of copies exceeds the number of receivable copies of the main tray 33 is checked (step 152).

Whether the number of copies exceeds the number of receivable copies can be checked in accordance with an operation of a copy number set key or by counting actually discharged copying sheets.

If a number of copying sheets more than the number of receivable copies of the main tray 33 are copied, an overflow mode is set (step 153), and the bin ascent/descent control means 35 is operated to move the bins 32 upward by one bin (steps 154 and 155). In this manner, an excessive copying sheet is discharged in the first bin 32 immediately below the main tray 33. When this bin 32 is used and the number of copies exceeds its capacity, control in which the bins 32 are moved upward by one bin and copying sheets are discharged in the next bin 32 is executed (steps 154 and 155). The number of copies which can be received in one bin is normally 50 to 100.

While the above processing is continuously performed, whether the set number of copies is reached is checked. If the set number of copies is reached, this overflow processing routine is ended (step 156).

Assume that the number of receivable copies of the main tray 33 is 150, the number of receivable copies of each bin 32 is 50, and the number of bins 32 is 20. In this case, since all the bins 32 can be used, the number of copies required in an ordinary use can be sufficiently covered.

As described above, when a number of copies more than the number of receivable copies of the main tray 33 is set and the number of received copies overflows, the overflow processing is immediately executed. Therefore, an overflow of a copying sheet to the outside can be prevented to prevent occurrence of jamming caused by the overflow.

As has been described above, according to the present invention, one of the two paper discharge modes, i.e., the non-shift mode and the shift mode can be selected.

According to the present invention, even when copying sheets discharged in a plurality of bins are simultaneously removed, they can be easily distinguished from each other. Therefore, a work for re-sorting the copying sheets and discriminating a relationship between a bin and a copying sheet can be completely omitted.

According to the present invention, the number of sets of copies to be copied can be set twice the number of bins. Therefore, a large number of sets of copies can be made with a small number of bins.

In addition, even when a number of sets of sheets more than the number of bins are copied in the sort mode, copied sheets of the same set are overlapped and discharged in units of two sheets. Therefore, since an influence of friction or static electricity can be reduced, copied sets can be easily sorted after copying. In particular, a large number of sets of copies can be easily and effectively handled.

In the present invention, when the non-sort mode using only the main tray is selected and the number of copies to be made is more than the number of receivable sheets of the main tray, the overflow processing is immediately performed to discharge remaining copying sheets to bins.

Therefore, even if a number of copies more than the number of receivable sheets of the main tray is set, all the sheets can be copied by one copy processing.

Since an overflowed sheet does not fall outside the machine to cause jamming, the present invention is convenient in practical use.

Therefore, the paper discharge apparatus according to the present invention can be suitably applied to a normal paper copying machine and the like.

In the above embodiment, a main tray and bins are of ascent/descent type. However, the paper discharge apparatus according to the present invention may apply to a type in which a main tray and bins are fixed and a paper discharge opening is movable upward and downward or another type in which a main tray and bins are fixed and recorded papers discharged from a paper discharge opening are distributed to each bin by means of a switching gate.

In the above embodiment, an electrophotographic copying machine is exemplified as a recording system. However, the present invention is not limited to the above embodiment but can be applied to any other type of recording system which discharges a recorded sheet.

What is claimed is:

1. A method of discharging recorded sheets into bins, the sheets being grouped into sets corresponding to a set of original documents, the method comprising the steps of:

firstly discharging first recorded sheets, corresponding to a first original document of the set of original documents, in a predetermined order into a normal position in the bins, the step of firstly discharging occurring in the predetermined order from an uppermost to a lowermost bin or from the lowermost to the uppermost bin;

secondly discharging the remaining sheets of the first recorded sheets into a shifted position, the step of secondly discharging occurring in an order opposed to the predetermined order from the last bin in the predetermined order to a final discharge bin determined in accordance with the number of remaining sheets, when one of the first recorded sheets is discharged into the last bin in the predetermined order;

thirdly discharging the second recorded sheets in the predetermined order into the shifted position, the step of thirdly discharging occurring in the predetermined order from the final discharge bin to the last bin, when second recorded sheets corresponding to a second original document of the set of original documents are discharged; and fourthly discharging the remaining sheets of the second recorded sheets into the normal position, the step of fourthly discharging occurring in the order opposed to the predetermined order from the last bin to the bin having the first discharged sheet of the first recorded sheets, when one of the second recorded sheets is discharged into the last bin in the predetermined order.

2. The method of claim 1 wherein the steps of firstly, secondly, thirdly and fourthly discharging shift from the normal position to the shifted position or from the shifted position to the normal position for every other bin.

3. The method of claim 1 further comprising a step of automatically switching from the normal position to the shifted position or from the shifted position to the normal position when an interrupt in copying occurs.

* * * * *